US006179748B1

(12) United States Patent
Barr

(10) Patent No.: US 6,179,748 B1
(45) Date of Patent: Jan. 30, 2001

(54) CHIN-UP BAR

(75) Inventor: David A. Barr, Arlington, TX (US)

(73) Assignee: Bollinger Industries, L.P., Grand Prairie, TX (US)

( * ) Notice: Under 35 U.S.C. 154(b), the term of this patent shall be extended for 0 days.

(21) Appl. No.: 09/249,176

(22) Filed: Feb. 9, 1999

(51) Int. Cl.[7] ..... A63B 1/00
(52) U.S. Cl. ..... 482/40; 482/38
(58) Field of Search ..... 482/38, 40, 141, 482/140, 904, 39

(56) References Cited

U.S. PATENT DOCUMENTS

| | | | | |
|---|---|---|---|---|
| 3,837,642 | * | 9/1974 | Martin | 482/38 |
| 3,915,452 | | 10/1975 | Winblad . | |
| 4,458,894 | | 7/1984 | Dudley . | |
| 4,513,961 | * | 4/1985 | Killen | 482/38 |
| 4,529,191 | | 7/1985 | Miller et al. . | |
| 4,844,448 | * | 7/1989 | Niznik | 482/40 |
| 5,180,350 | * | 1/1993 | Thomas | 482/38 |
| 5,417,628 | | 5/1995 | Vanderbleek . | |
| 5,752,903 | * | 5/1998 | Chang | 482/40 |

OTHER PUBLICATIONS

Body Builder's Discount Outlet (BDO) Catalog, pp. 41–42 copyright 1994.*

* cited by examiner

*Primary Examiner*—Stephen R. Crow
(74) *Attorney, Agent, or Firm*—Felsman, Bradley, Vaden, Gunter & Dillon, L.L.P.; James E. Bradley

(57) ABSTRACT

A doorway mounted chin-up bar has a rod with an interior tube that is telescopically received within a rotating sleeve. A mount is positioned on each end of the rod for securing the rod to a doorjamb. A pair of U-shaped extension bars extend outward and upward from the rod. Each of the extension bars have first and second ends that extend out of planes that are defined by the doorway in first and second directions, respectively. A first hand-grip bar is affixed to the first ends of the extension bars and a second hand-grip bar is affixed to the second ends of the extension bars. When a user grasps the first hand-grip bar and pulls down, the extension bars pivot about the rod until the second hand-grip bar engages a wall surface above the doorway. The user may engage in chin-ups while being supported by the first hand-grip bar. Alternatively, a user may grasp the second hand-grip bar and pull down until the first hand-grip bar engages a wall surface above the doorway. The second hand-grip bar supports the user while the user engages in chin-ups. The first and second hand-grip bars are different distances away from the rod such that the hand-grip bars will be at different heights above the floor.

10 Claims, 2 Drawing Sheets

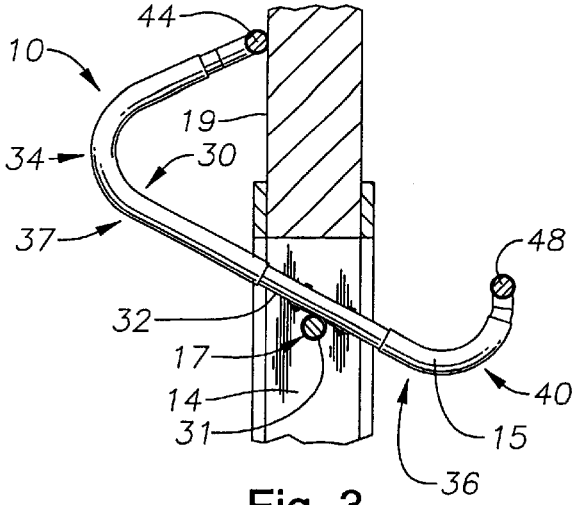
Fig. 3
Fig. 4
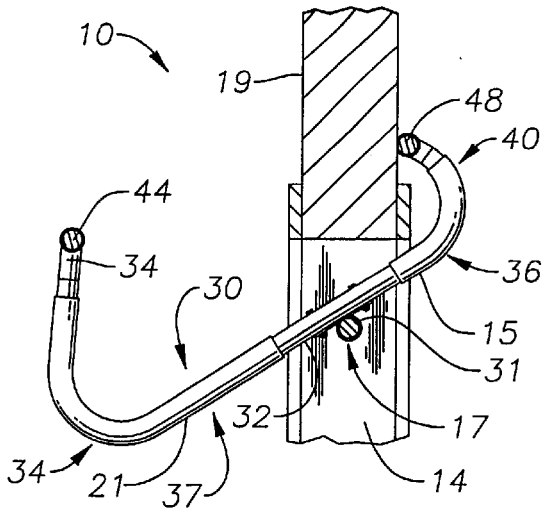
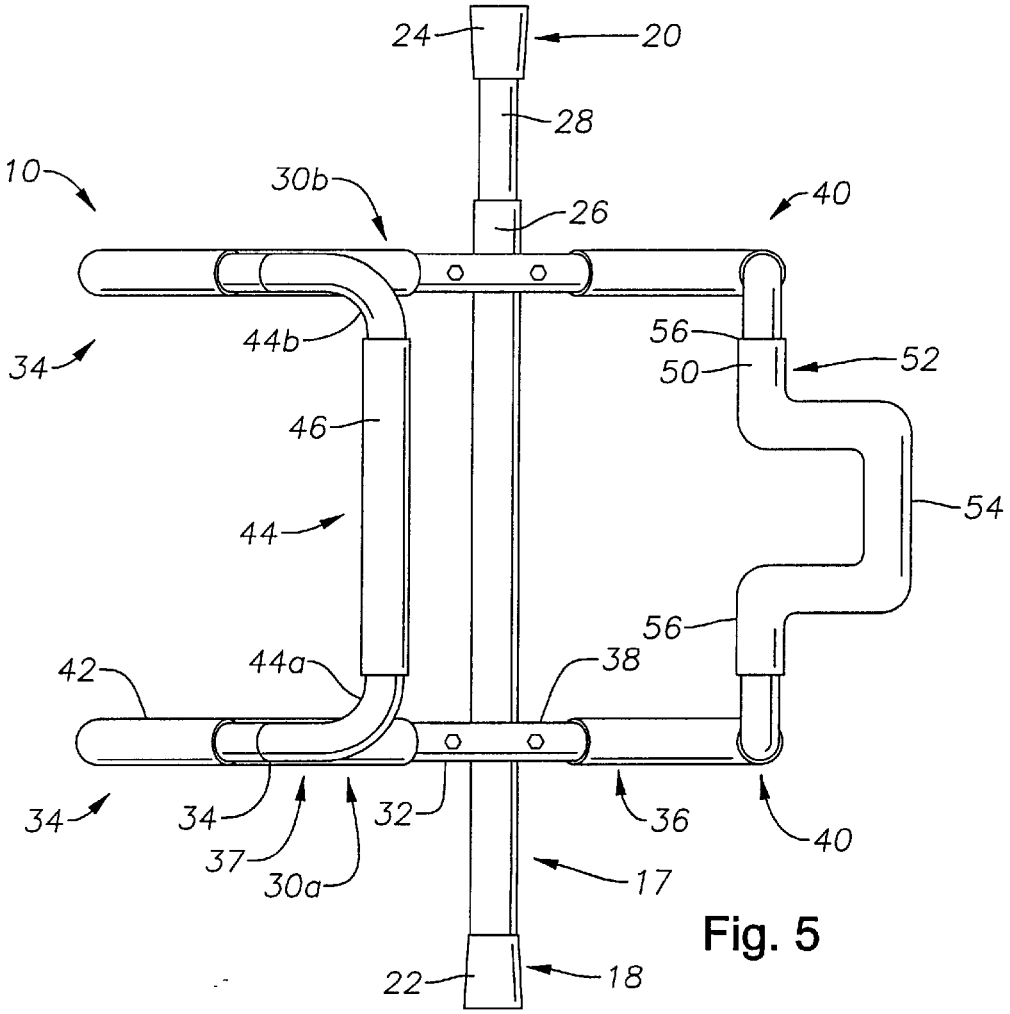
Fig. 5

CHIN-UP BAR

TECHNICAL FIELD

This invention relates to home exercise equipment. In particular, the invention relates to a chin-bar that may be installed within a doorway of a home and that is adjustable to accommodate users of different heights.

BACKGROUND OF THE INVENTION

Door mounted exercise bar devices are known in the art. Exercise bar devices are taught in U.S. Pat. No. 3,915,452 to Winblad for a "Portable Chinning Bar Assembly", U.S. Pat. No. 4,529,191 to Miller, et al. for a "Doorway Mounted Horizontal Bar", U.S. Pat. No. 5,417,628 to Vanderbleek for an "Exercise Device for Chin-Ups" and U.S. Pat. No. 5,180,350 to Thomas for an "Exercise Bar Apparatus". The related art devices teach various methods and devices for mounting an exercise bar within a doorway. U.S. Pat. No. 4,458,894 to Dudley for a "Portable Support Bar Assembly" teaches a device for affixing a first horizontal bar to a door-jamb for supporting a second horizontal support bar outwardly and above a doorway. Improvements are desired in ease of installation. Also, a disadvantage with the related art devices is that once the exercise device is secure within a doorway, the hand-grip bar is set at a specific height. Therefore, the device does not easily accommodate users of different heights.

BRIEF SUMMARY OF THE INVENTION

The apparatus of the invention is a doorway mounted chin-up bar device having a rod that secures to an inside of a doorway. Preferably, the rod is comprised of an interior tube and an exterior rotating sleeve, wherein the interior tube is received in telescoping engagement within the rotating sleeve. A mount is positioned on each end of the rod for securing the rod within the doorway.

A pair of approximately U-shaped extension bars are pivotally affixed perpendicularly to the rod. The extension bars extend outward from the rod and extend upward. The extension bars have a first end that extends out of a plane defined by the doorway in a first direction and a second end that extends out of the plane of the doorway in a second direction. A first hand-grip bar is affixed to the first end of the extension bars and a second hand-grip bar is affixed to a second end of the extension bars.

When a user grasps the first hand-grip bar and pulls down, the extension bars pivot about the rod until the second hand-grip bar engages a wall surface above the doorway. The user may proceed to engage in chin-ups while being supported by the first hand-grip bar.

Alternatively, the user may grasp the second hand-grip bar and pull down. The extension bars will pivot about the rod until the first hand-grip bar engages the wall surface above the doorway. The second hand-grip bar may then support the user while the user engages in chin-ups. The first hand-grip bar may be located further away from the rod than the second hand-grip bar. Since the first hand-grip bar and second hand-grip bar may be at different distances away from the rod, the height from the floor of a hand-grip bar may vary according to whether the user is being supported by the first hand-grip bar or the second hand-grip bar.

DESCRIPTION OF THE DRAWINGS

FIG. 3 is an elevational cross-sectional view of the device in FIG. 1, shown wherein the first hand-grip bar is positioned for use.

FIG. 4 is a cross-sectional elevational view of the device of FIG. 1 wherein the second hand-grip bar is positioned for use.

FIG. 5 is a plan view of a second embodiment of the invention wherein the first hand-grip is irregularly shaped so that a portion of the hand-grip is parallel to the extension bars.

DETAILED DESCRIPTION OF THE INVENTION

Figure 1:
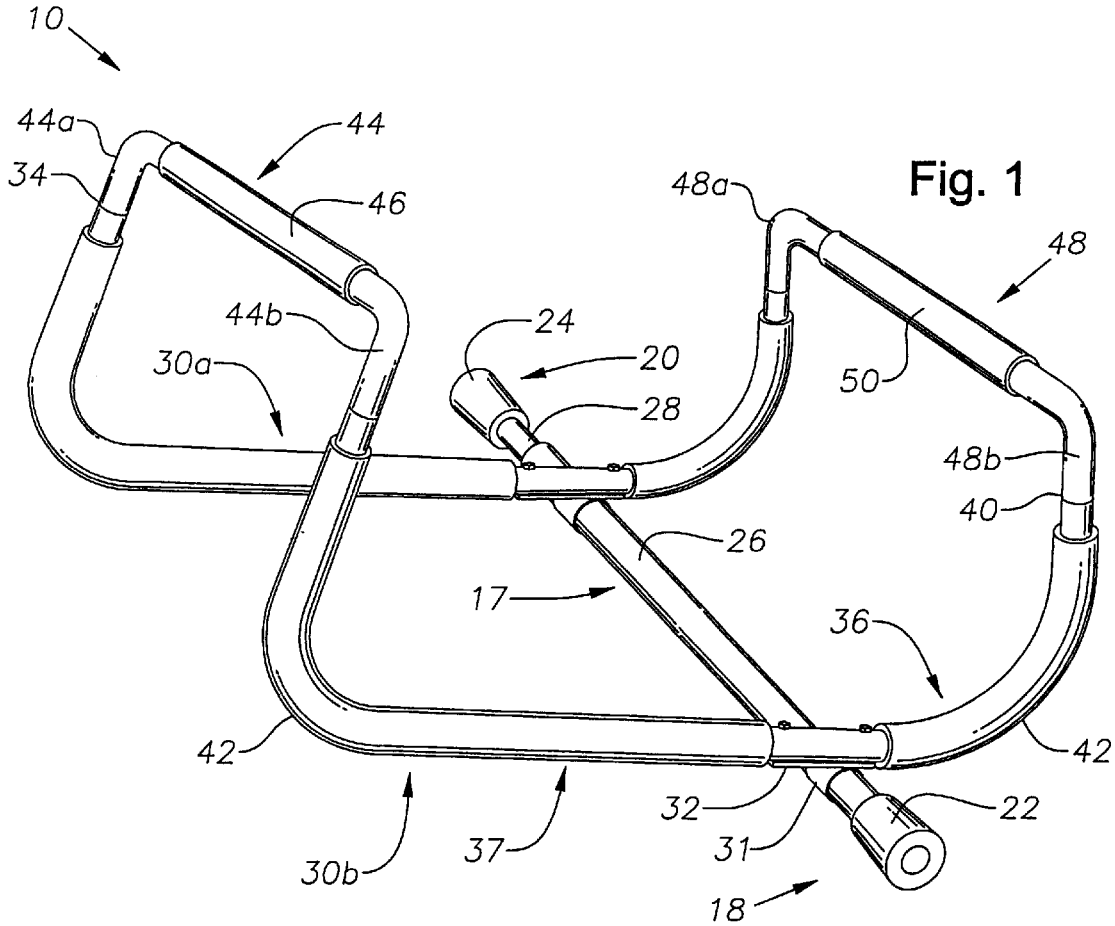
FIG. 1 is a perspective view of the chin-up device of the invention.
Figure 2:
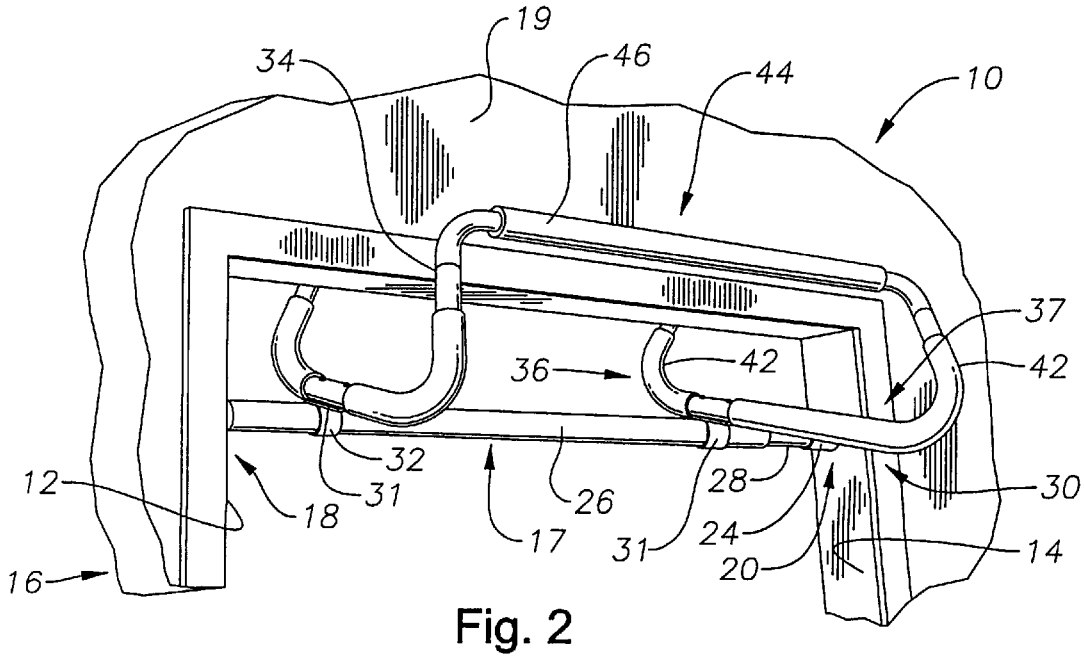
FIG. 2 is a perspective view of the chin-up device of FIG. 1 shown installed within a doorway.

Referring now to FIGS. 1–5, the chin-up bar apparatus is designated generally 10. Chin-up bar apparatus 10 is designed to be installed between the door-jambs 12 and 14 of doorway 16 having a wall surface 19 thereabove (FIG. 2). Chin-up bar apparatus 10 has a rod 17 having a fixed end 18 and a telescoping end 20. A mount 22 is positioned on fixed end 18 of rod 17 and a mount 24 is positioned on telescoping end 20 of rod 17. Mounts 22 and 24 engage door-jambs 12 and 14 and may be secured to door-jambs 12 and 14 by screws. Additionally, supports (not shown) may be secured to door-jambs 12 and 14 that are designed to receive mounts 22 and 24. In the preferred embodiment, rod 17 is made up of a rotating sleeve 26 that telescopically receives interior tube 28. Rod 17 may, therefore, be adjusted in length to accommodate various widths of doorway 16.

In the preferred embodiment, a pair of extension bars 30*a* and 30*b* are clamped to exterior rotating sleeve 26 with clamps 31. Therefore, extension bars 30*a*, 30*b* may pivot about rod 17. Extension bars 30*a*, 30*b* each have a straight portion 32 and two curved ends 34 and 40. Straight portion 32 is secured by clamps 31 to rotating sleeve 26. In the preferred embodiment, clamps 31 are located closer to curved portions 40 than to curved portions 34.

Preferably, short extension bar portions 36 do not extend as far from rod 17 as long extension bar portions 37. Padded sleeves 42 may be provided on straight portion 32 and curved portions 34, 40 to protect the user and for aesthetic purposes. A first hand-grip bar 44 is affixed transversely between the curved ends 34 of extension bars 30*a*, 30*b*. First hand-grip bar 44 has a first end 44*a* and a second end 44*b*, which are at 90° relative to bar 44 and insert into curved ends 34. Preferably, a padded hand-grip 46 is provided on first hand-grip bar 44. Similarly, a second hand-grip bar 48 having a first end 48*a* and a second end 48*b* is affixed to curved ends 40 extension bars 30*a*, 30*b*. Preferably, a padded hand-grip 50 is provided on second hand-grip bar 48. Hand-grip bars 44,48 are parallel to each other and to bar 17.

In use, the chin-up bar of the invention is installed within a doorway 16. Screws may be used to secure mounts 22 and 24 to door-jambs 12 and 14. The chin-up bar apparatus 10 is located so that hand-grip bar 48 contacts the wall surface 19 above doorway 16 when tilted up as shown in FIG. 4. The user approaches the chin-up bar apparatus 10 and selects either the first hand-grip bar 44 or second hand-grip bar 48 to grasp and pull downward. If the user selects first hand-grip bar 44, the extension bars 30*a* and 30*b*, along with hand-grip bars 44 and 48 will pivot about rod 17 along with sleeve 26. Second hand-grip bar 48 will move up towards the ceiling and into engagement with a wall surface 19 above a doorway 16. When the second hand-grip bar 48 has engaged wall surface 19 above the doorway 16, then the chin-up bar apparatus 10 is in position to support a user's weight from the first hand-grip bar 44 (FIG. 4).

Similarly, the user may elect to grasp the second hand-grip bar 48, which will pivot the extension bars 30*a* and 30*b*, along with hand-grip bars 44 and 48 about rod 17 until the first hand-grip bar 44 engages wall surface 19 above the doorway 16. When the chin-up bar 10 is in this position, the second hand-grip bar 48 is prepared to support the weight of a user. (FIG. 3).

If the long extension bar portions 37 and the short extension bar portions 36 are of different lengths, the first hand-grip bar 44 is a first distance from a floor surface when the chin-up bar apparatus 10 is in a first position (FIG. 4) and the second hand-grip bar 48 is a second and different distance from the floor when the chin-up bar apparatus 10 is in a second position (FIG. 3). Therefore, the chin-up bar apparatus 10 of the invention can easily accommodate users of different heights by providing first and second hand-grip bars 44 and 48, which are two different heights from the floor when in position for use.

Referring to FIG. 5, in an alternate embodiment, either or both of first hand-grip bar 44 and/or second hand-grip bar 48 may be of an irregular shape. An example includes a configuration wherein a portion of the hand-grip bar 44 and/or 48 are parallel to the extension bars 30*a* and 30*b*. For illustrative purposes, hand-grip bar 48 has been replaced with irregular hand-grip bar 52 in FIG. 5. Bar 52 has offset portion 54 , which is in the center of hand-grip bar 52 and offset from outside portions 56. Portions 56 are parallel to the plane of extension bars 30*a* and 30*b* in the preferred embodiment. An irregularly shaped hand-grip bar allows the user to grip the hand-grip bar in a different manner for the purpose of exercising different muscles. Additionally, other hand-grip bars of other irregular shapes besides that shown in FIG. 5 may be provided.

In the alternate embodiment, a user may grasp offset portion 54 of irregularly-shaped hand-grip bar 52 (FIG. 5) to engage in a variation of the traditional chin-up exercise. Although an irregular shaped hand-grip bar 52 is shown on only one side of the chin-up bar apparatus 10, an irregularly shaped hand-grip bar 52 may be utilized on one or both sides of chin-up bar apparatus 10.

The chin-up bar apparatus of the invention has several advantages. The chin-up bar enables a quick and easy change between two heights of the hand-grip bar to enable users of different heights to use the apparatus. Additionally, the chin-up bar apparatus may be easily installed within doorways of different widths. Further advantages are apparent from the preceding specification.

Although the invention is shown in only one of its forms, it should be apparent to those skilled in the art that it is not so limited, but is susceptible to various changes without departing from the scope of the invention. For example, each extension bar may be formed from several pieces rather than an single piece. Additionally, the first hand-grip bar may be integrally formed with the extension bar and the second hand-grip bar may be integrally formed with the extension bar. Further, additional irregularly-shaped hand-grip bars may be utilized to further vary the exercises available to a user. Finally, the apparatus of the invention may be used for exercises other than chin-up devices and may have special adaptive equipment provided on the hand-grip bar to facilitate such exercises.

What is claimed is:

1. A chin-up bar for installation in a doorway comprising:

a rod having ends that are adapted to be secured to an inside frame of a doorway;

a pair of extension bars transversely affixed to said rod for pivotal movement relative to said ends of said rod, each of said extension bars extending outward from said rod and having a first end and a second end;

a first hand-grip bar on each of said first ends of said extension bars; and a second hand-grip bar on each of said second ends of said extension bars, whereby a user may pull downward on said first hand-grip bar, causing said second hand-grip bar to move upward and engage a wall surface above the doorway, and a user may pull downward on said second hand-grip bar, causing said first hand-grip bar to move upward and engage a wall surface above the doorway.

2. The chin-up bar according to claim 1 wherein:

said extension bars are mounted to said rod with said first hand-grip bar farther from said rod than said second hand-grip bar, so that said first hand-grip bar is adapted to be at a first height from a floor when said second hand-grip bar is contacting said wall surface and said second hand-grip bar is a second height from said floor when said first hand-grip bar is contacting said wall surface.

3. The chin-up bar according to claim 1 wherein:

at least one of said first hand-grip bar and said second hand-grip bar has an offset portion extending transversely to said rod.

4. The chin-up bar according to claim 1 wherein:

said extension bars are perpendicular to said rod.

5. The chin-up bar according to claim 1 wherein:

each of said extension bars has a central straight portion and two upwardly curved ends with a hand-grip bar extending from each of said upwardly curved ends.

6. The chin-up bar according to claim 1 wherein:

said rod has end pieces on said ends that are adapted to be secured to an inside frame of a doorway; and wherein said rod is comprised of a sleeve that is rotatable with respect to said end pieces, wherein each of said extension bars is secured to said sleeve to cause said sleeve to rotate when the extension bars are pivoted about said rod.

7. The chin-up bar according to claim 1 further comprising:

padding on both hand-grip bars.

8. A chin-up bar for installation in a doorway comprising:

a rod having end pieces on ends of said rod that are adapted to be secured to an inside of a doorway, said rod having a sleeve that is rotatable with respect to said end pieces;

a pair of extension bars secured to said sleeve that cause said sleeve to rotate when said extension bars are pivoted about said rod, each of said extension bars extending outward from said rod parallel to one another and perpendicular to said rod, said extension bars having a central straight portion, a first upwardly curved end, and a second upwardly curved end;

a first hand-grip bar extending between said first upwardly curved ends of said extension bars;

a second hand-grip bar extending between said second upwardly curved ends of said extension bars; whereby a user may pull downward on said first hand-grip bar, causing said second hand-grip bar to move upward and engage a wall surface above the doorway, and a user may pull downward on said second hand-grip bar, causing said first hand-grip bar to move upward and engage a wall surface above the doorway.

9. The chin-up bar according to claim 8, further comprising:

padding on both hand-grip bars.

10. The chin-up bar according to claim 8, wherein:

at least one of said first hand-grip bar and said second hand-grip bar has an offset portion extending perpendicular to said rod.

* * * * *